US005618479A

United States Patent [19]

Lijten et al.

[11] Patent Number: 5,618,479

[45] Date of Patent: Apr. 8, 1997

[54] PROCESS OF MAKING CORE-SHEATH FILAMENT YARNS

[75] Inventors: Franciscus A. T. Lijten, Heveadorp; Johannes J. Meerman, Arnhem, both of Netherlands

[73] Assignee: Akzo N.V., Arnhem, Netherlands

[21] Appl. No.: 478,780

[22] Filed: Jun. 7, 1995

Related U.S. Application Data

[62] Division of Ser. No. 328,605, Oct. 25, 1994, Pat. No. 5,468,555, which is a continuation of Ser. No. 139,883, Oct. 22, 1993, abandoned, which is a continuation of Ser. No. 635,185, filed as PCT/EP90/00778 May 14, 1990, abandoned.

[30] Foreign Application Priority Data

May 16, 1989 [DE] Germany ..... 39 15 819.5
Aug. 9, 1989 [DE] Germany ..... 39 26 246.4

[51] Int. Cl.[6] ..... D01D 5/12; D01F 8/04

[52] U.S. Cl. ..... 264/103; 264/172.11; 264/172.15; 264/210.8

[58] Field of Search ..... 264/103, 172.11, 264/172.15, 210.8

[56] References Cited

U.S. PATENT DOCUMENTS

| | | | |
|---|---|---|---|
| 3,616,183 | 10/1971 | Brayford et al. . | |
| 3,700,544 | 10/1972 | Matsui | 428/373 |
| 3,704,971 | 12/1972 | Baird et al. . | |
| 3,780,149 | 12/1973 | Keuchel et al. . | |
| 3,839,140 | 10/1974 | Tyler et al. | 428/373 |
| 3,847,524 | 11/1974 | Mott . | |
| 3,969,559 | 7/1976 | Boe | 428/374 |
| 3,988,883 | 11/1976 | Sze . | |
| 4,059,949 | 11/1977 | Lee . | |
| 4,293,516 | 10/1981 | Parkin . | |
| 4,406,850 | 9/1983 | Hills . | |
| 4,439,487 | 3/1984 | Jennings | 428/374 |
| 4,457,974 | 7/1984 | Summer | 428/373 |
| 4,473,617 | 9/1984 | van Leeuwen et al. . | |
| 4,867,925 | 9/1989 | Feijen et al. . | |
| 4,943,481 | 7/1990 | Schilo et al. | 428/374 |
| 5,092,381 | 3/1992 | Feijen et al. . | |
| 5,352,518 | 10/1994 | Muramoto et al. . | |

FOREIGN PATENT DOCUMENTS

| | | |
|---|---|---|
| 0011954 | 6/1980 | European Pat. Off. . |
| 0056667 | 7/1982 | European Pat. Off. . |
| 0201114 | 12/1986 | European Pat. Off. . |
| 1158205 | 11/1963 | Germany . |
| 61-63708 | 4/1986 | Japan . |
| 63-190007 | 8/1988 | Japan . |

*Primary Examiner*—Leo B. Tentoni
*Attorney, Agent, or Firm*—Oliff & Berridge

[57] ABSTRACT

In a yarn composed of core-sheath filaments with or without further monocomponent filaments, the core and the sheath of the core-sheath filaments are produced by extruding spinnable polymers, with at least almost all the core-sheath filaments having a complete sheath. Of all the core-sheath filaments in the yarn, the proportion of core-sheath filaments P, in %, of which each core-sheath filament has (S±0.1 S) % of sheath content (based on the total volume of the particular core-sheath filament), meets the following conditions: $P \leqq 100$, $S \geqq 0.5$, and $P \geqq 30+(0.1\ S)^8\%$. This yarn can be produced by a process wherein the core component is fed via a first spinneret plate to a second spinneret plate in a plurality of individual streams, and between the first and second spinneret plate each individual stream of core component is enveloped by the sheath component being fed onto it, and the two components are conjointly spun, drawn and wound up. At least in the area surrounding the individual streams of core component, the sheath component is subjected to a flow resistance. A suitable flow resistance may be provided by a wire mesh.

10 Claims, 8 Drawing Sheets

PROCESS OF MAKING CORE-SHEATH FILAMENT YARNS

This is a Division of Application No. 08/328,605 filed Oct. 25, 1994, now U.S. Pat. No. 5,468,555, which in turn is a Continuation of Application Ser. No. 08/139,883 filed Oct. 22, 1993, now abandoned, which in turn is a Continuation of Application Ser. No. 07/635,185, filed as PCT/EP90/00778 May 14, 1990, now abandoned.

TECHNICAL FIELD

The invention relates to a yarn formed from core-sheath filaments where the core and the sheath of the core-sheath filaments have been produced by extruding and to a process for producing the same.

BACKGROUND

Core-sheath filaments and production processes therefor are widely known. For instance, it is pointed out in EP-A-0 011 954 that special spinning equipment is required to avoid the occurrence of homofilaments even at a low sheath content. Despite the avoidance of homofilaments through the use of the known spinning equipment, it is impossible to avoid the presence in the resulting yarn of core-sheath filaments with a highly fluctuating sheath content, including sections without any sheath content, and a wide range of fluctuation of the sheath content of the core-sheath filaments within the resulting yarn.

Experiments have shown that in using a spinning apparatus as described in EP-A-0 011 954 and a feed of core and sheath material in a volume ratio of 85:15, as described therein in the Example, not more than 15% of the core-sheath filaments obtained in the yarn, generally even fewer, have a sheath content of about 15%, even if a sheath content fluctuation of ±10% is taken into account. The other core-sheath filaments in the yarn obtained have a higher (up to 30% by volume) or a smaller (down to below 5% by volume) sheath content.

Nor is it possible with the known process to obtain one or more homofilaments in the yarn in a controlled manner. The production of homofilaments is purely adventitious. There is no guarantee that a homofilament which is discernible in the yarn cross-section remains a homofilament in the yarn direction. On the contrary, viewed in the linear direction of the yarn, a homofilament will change into a core-sheath filament and vice versa.

The high fluctuation of the sheath content has the effect that every filament in the yarn has different properties. This means that the filaments in the yarn have widely differing properties, which is undesirable.

Basically, yarns composed of core-sheath filaments should have the desirable properties of a core material (strength, shrinkage, extension, birefringence, etc.) while the sheath improves the other properties of the yarn (adhesion to other materials, dyeability, fastness to handling, chemical and mechanical resistance, etc.). In existing processes, the average sheath content must be 20% by volume or more in order to keep the fluctuation of the sheath content within limits and to keep the properties of the core material uniform, to some degree, based on the total cross-section of the core-sheath filament.

SUMMARY OF THE INVENTION

The present invention has for its object to provide new, better performing yarns composed of core-sheath filaments which may contain single-component filaments (homofilaments) where the core and the sheath of the core-sheath filaments are produced by extruding spinnable polymers and at least almost all the core-sheath filaments have a complete sheath. The yarns should ensure better utilization of the properties of the core-sheath material without deterioration in the properties of the sheath material.

It is another object of the present invention to provide a process for producing these yarns which ensures better uniformity of the yarns and which makes it possible to set the proportion of the single-component filaments and of the core-sheath filaments (bicomponent filaments) in a controlled and predictable manner. The sheath content of the core-sheath filaments should be more uniform even below 20% by volume.

This object is achieved when, of all the core-sheath filaments in the yarn, the proportion of core-sheath filaments P, in %, of which each core-sheath filament has (S±0.1 S) % of sheath content, in the total volume of the particular core-sheath filament, meets the following conditions at one and the same time: when $P \leqq 100\%$ and $S \geqq 0.5$; $P \geqq 30 + (0.1S)^8\%$.

The term (S±0.1S) % means that P is determined by taking into account all the core-sheath filaments which have a sheath content of S % by volume based on the total volume of the particular core-sheath filament, the sheath content S being determined on the basis of a range of ±10%. Since the abovementioned conditions must be met at one and the same time, it follows that S can assume only those values at which P is not more than 100%.

Especially yarns according to the present invention where $$P \geqq 40 + 7(0.1\ S)^8\%.$$

preferably $$P \geqq 50 + 100\ (0.1\ S)^8\%$$

have excellent properties.

Depending on the intended use, preference is given to yarns where at least 60% of the core-sheath filaments have a sheath content of (S±0.1 S) % by volume where $S \leqq 9\%$ by volume, or yarns where at least 70% of the core-sheath filaments have a sheath content (S±0.1 S) % where 1% by volume $\leqq S \leqq 7\%$ by volume, or yarns where at least 75% of the core-sheath filaments have a sheath content (S±0.1 S) % where 3% by volume $\leqq S \leqq 6\%$ by volume.

Surprisingly, such yarns show distinct improvements in specific properties. For example, the tenacity (cN/dtex) of yarns according to the present invention is distinctly higher than that of existing yarns composed of core-sheath filaments and also that of monocomponent yarns composed only of the core polymer.

DETAILED DESCRIPTION OF PREFERRED EMBODIMENTS

Figure 1:
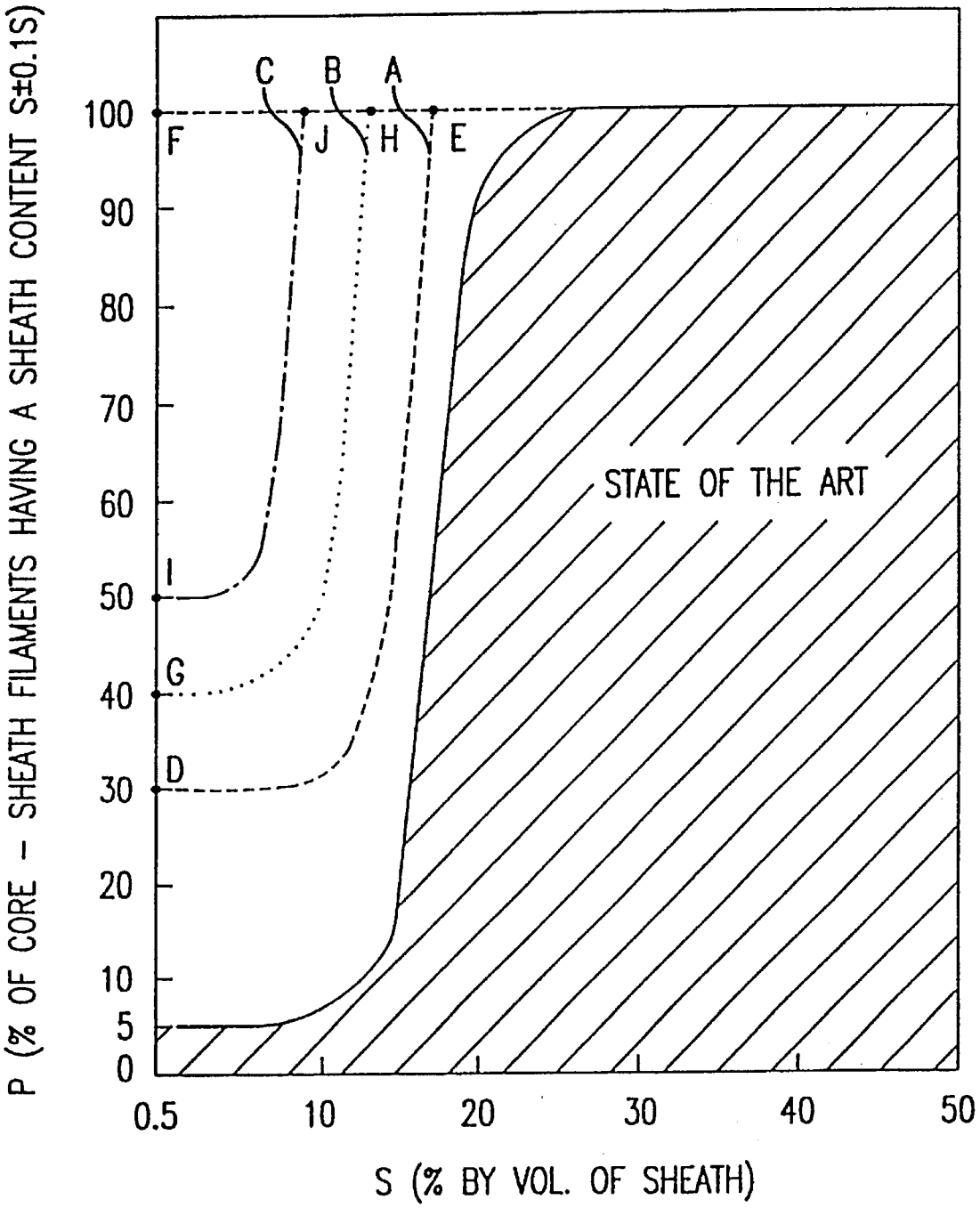
FIG. 1 shows the domain opened up by yarns according to the present invention compared with the state of the art.

The filaments of the yarn according to the invention may have virtually any known cross-sectional shape. For example, filaments having a round cross-section are preferred for tire cords, while filaments having a trilobal cross-section are preferred if the emphasis is to be on visual effects which may be desirable for example in carpet yarns.

Specific properties of the yarn, for example adhesivity, are particularly pronounced when the filaments, in particular the core-sheath filaments, have a trilobal cross-section.

Suitable polymer combinations for the core and the sheath are in particular the following polymers:

| Core | Sheath |
|---|---|
| Polyethylene terephthalate (PET) | Nylon 66 (PA 66) |
| Polyethylene terephthalate (PET) | Mixture of nylon 66 (PA 66) and poly(m-xylyleneadipamide) |
| Nylon 46 (PA 46) | Nylon 66 (PA 66) |
| Polyethylene terephthalate (PET) of high viscosity | Polyethylene terephthalate (PET) of low viscosity |
| Polyethylene terephthalate (PET) | Mixture of polyethylene terephthalate (PET) and polyvinylene difluoride (PVDF) |
| Polyethylene naphthalate (PEN) | Nylon 66 (PA 66) |
| Polyethylene naphthalate (PEN) | Nylon 46 (PA 46) |

Further favorable combinations are:

| Core | Sheath |
|---|---|
| Polyethylene terephthalate (PET) | Polyether sulphone (PES) |
| Nylon 66 (PA 66) with high viscosity | Nylon 66 (PA 66) with low viscosity |
| Nylon 6 (PA 6) with higher viscosity | Nylon 6 (PA 6) with low viscosity |
| Polyethylene terephthalate (PET) | Polytetrafluoroethylene (PTFE) |
| Polyethylene terephthalate (PET) | Polyimide |
| Polyethylene terephthalate (PET) | Polyphenylene sulphide (PPS) |
| Polyethylene terephthalate (PET) | Polypropylene (PP) |
| Polyethylene terephthalate (PET) | Mixture of polyethylene terephthalate (PET) and polytetrafluoroethylene (PTFE) |
| Polyethylene therphthalate (PET) | Mixture of polyethylene terephthalate (PET) and poly(m-xylyleneadipamide) |
| Nylon 6 (PA 6) | Polypropylene (PP) |
| Nylon 6 (PA 6) | Polyvinylene difluoride (PVDF) |

The yarns according to the present invention have many applications.

Sewing yarns formed with customary polymers in the core (PET, PA 66, PA 6) can be enveloped with high temperature resistant polymers and thus become suitable for very high sewing speeds. In the case of ropes and nets made of yarns, the sheath can improve the chemical resistance, the UV resistance and the temperature resistance.

In the case of yarns for reinforcing elastomers, for example in the case of tire cord, which are used for reinforcing pneumatic tires, drivebelts or conveyor belts, the sheath of the core-sheath filaments can improve the adhesion between core and elastomer. Similarly with fiber-reinforced plastics, this method makes it possible to improve the adhesion between yarn and plastic.

In the case of carpet yarns, the sheath of the core-sheath filaments can serve to improve the dyeability of the filaments, even if the core consists of a highly conductive material for improving the antistatic properties whose color is frequently very dark and poorly dyeable with other colors. By having differences in shrinkage between the core and the sheath in the materials, it is possible, if such yarns are used for manufacturing carpets, to create a distinct crimping of the yarn in the finished carpet or textile products by heating. Profiled yarns improve the light scattering. The right choice of sheath material for the core-sheath filament significantly improves the flammability rating and/or the soiling characteristics of carpets or textiles made from such core-sheath filaments. Similarly, molding or rotting can be reduced.

A hydrophobic sheath can efficiently prevent the absorption of moisture by the core-sheath filaments. This is of particular interest for use of the yarns according to the invention in the textile sector. It is also possible to spin mixtures of polymers with color pigments as sheath component to produce spun-dyed core-sheath filaments.

If the yarns according to the present invention are to be used in nonwovens, the appropriate choice of polymers can improve chemical resistance, for example in nonwovens for filter duty. It is also possible to obtain ion exchanger properties or to influence the flammability rating.

The object of the present invention is also achieved by a process for producing the yarns according to the present invention, wherein in a conventional manner (EP-A-0 011 954) the core component is fed via a first spinneret plate to a second spinneret plate in a plurality of individual streams, and between the first and the second spinneret plate each individual stream of core component is enveloped by the sheath component being fed onto it, and the two components are conjointly spun, drawn and wound up, characterized in that at least in the area surrounding the individual streams of core component, the sheath component is subjected to a flow resistance.

The process according to the present invention can be carried out as a single-stage process (without intermediate winding-up) or as a multi-stage process (with intermediate winding-up).

A suitable flow resistor is in particular a wire mesh with a hole for each individual stream. It is advantageous if the wire mesh occupies the entire space between the first and the second spinneret plate except for the holes for the individual streams. It is also possible to use other flow resistors, for example porous plates. Using a wire mesh it is possible even in the case of relatively large spinneret plates to keep the distance between the two spinneret plates the same everywhere, since the wire mesh also acts as a spacer plate.

In this way it is also possible, in a simple and controlled manner, to produce core-sheath filaments with different sheath contents from filament to filament. To this end, different resistances for the sheath streams are chosen for the individual core streams. If the resistance chosen is so high that the sheath material does not envelop a specific core stream, the result is simply a single-component filament.

Suitable wire meshes are in particular those which are commercially available under the designation R.V.S. x mesh rolled,,where x is from 30 to 500. R.V.S. signifies a stainless steel, while x mesh indicates that there are x wires per inch in both directions of the mesh, the interwoven wires forming the mesh being from 0.5 to 0.025 mm in diameter.

The flow resistance can also be determined by the permeability of the flow resistor. The permeability K is defined by $$K = -\frac{\eta V}{\delta p/\delta x}$$

where $\eta$ is the viscosity of the fluid in Pa . s,

V is the velocity of the fluid through the flow resistor in m/sec, and $\delta p/\delta x$ is the pressure gradient in $N/m^3$ in the flow direction.

The permeability consequently has units of $m^2$.

The permeability K of the flow resistor to be used is preferably between $10^{-11}$ and $3\times10^{-10}$ $m^2$.

It is particularly surprising that the process according to the present invention can be employed not only for melt spinning but also for solvent spinning or a combination thereof. For example, both components can be formed by melt spinning or solvent spinning. However, it is also possible for example to produce the core component by melt spinning and the sheath component by solvent spinning. Solvent spinning means that the spinning solution consists of a polymer dissolved in a solvent, while melt spinning consists of the spinning of a molten polymer.

If the first and the second spinneret plate each have only one spinneret orifice, the process according to the present invention can be used to produce a core-sheath monofilament which has a sheath of highly uniform thickness across the circumference and along the length of the core-sheath monofilament.

The invention is further illustrated by examples with reference to the accompanying figures.

FIG. 1 shows the domain which has become accessible through the core-sheath filament yarns according to the present invention. In the diagram, the abscissa is the sheath content, in %, by volume, and the ordinate is the proportion P, in %, of the core-sheath filaments of all the core-sheath filaments in the yarn which have a sheath content of (S±0.1 S) %. The distribution possible in the state of the art is indicated by the hatched area labelled "State of the art". It follows that, by state of the art technology, it was easily possible to produce yarns composed of core-sheath filaments having a sheath content of 25% where all the core-sheath filaments have a sheath content of 25%, whereas in the case of a yarn containing core-sheath filaments with a sheath content of 10% only 5% have a sheath content of 10%. The present invention now provides yarns of distinctly improved uniformity. Here curve A corresponds to the conditions of claim 1, curve B to the conditions of claim 2, and curve C to the conditions of claim 3.

Figure 2:
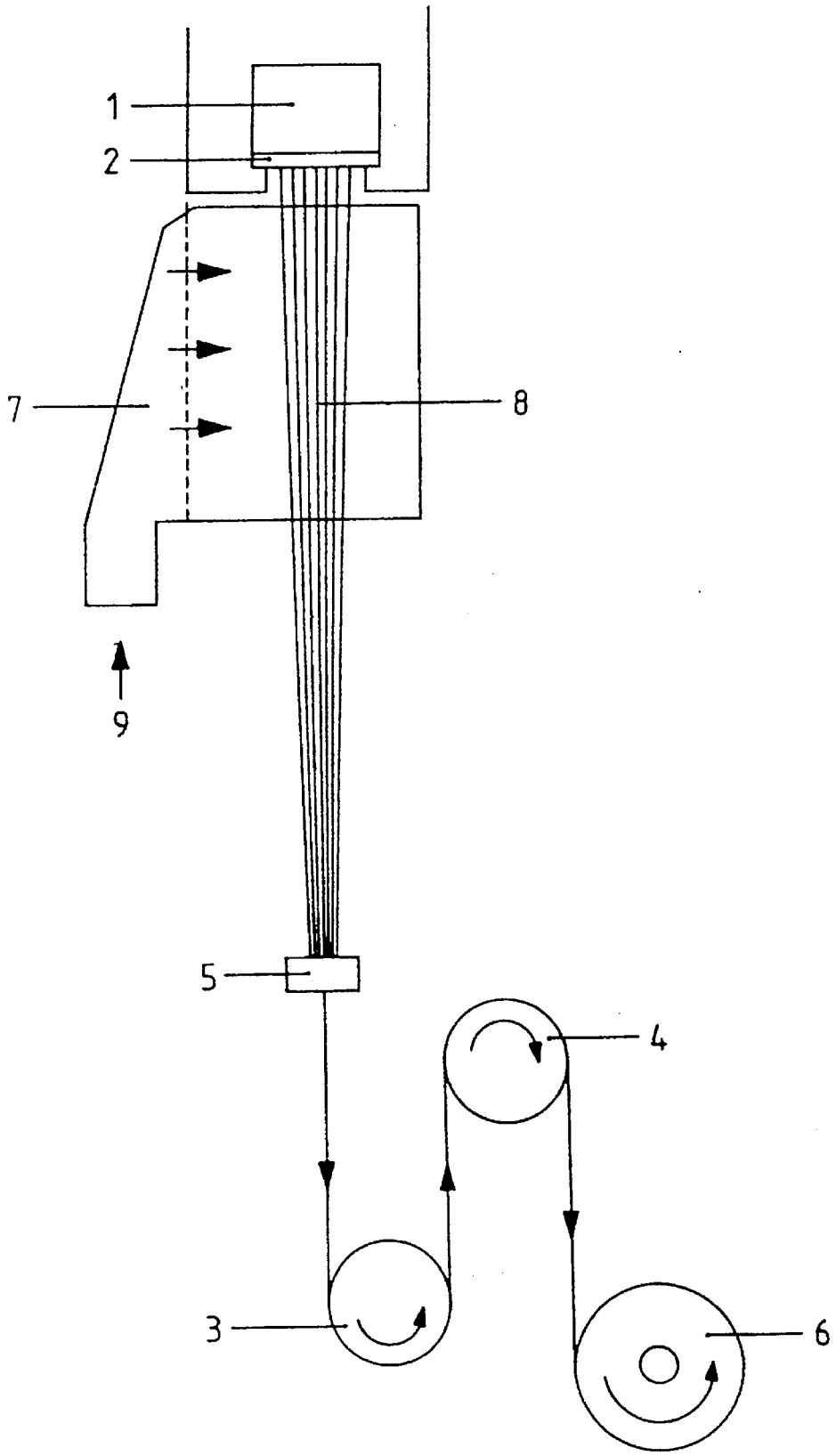
FIG. 2 shows a process flow diagram for producing yarns according to the present invention.

FIG. 2 is a schematic flow diagram of a process for producing the yarns according to the present invention. Here 1 signifies a spinneret pack to which is flanged a spinneret plate combination 2 which hereinafter will be explained in detail with reference to FIGS. 3, 4, 5 and 6. Upstream of the spinneret pack 1 are the usual extruder and melt lines (not depicted in the Figure). On leaving, the spun core-sheath filaments or homofilaments 8 pass through a quenching cell 7 which is supplied with quenching air 9. The filaments pass over a spin finish application roll 5, where they are gathered together and from where they pass into a drawing unit 3, 4 to be wound up thereafter on a bobbin 6 as finished yarn.

Figure 3:
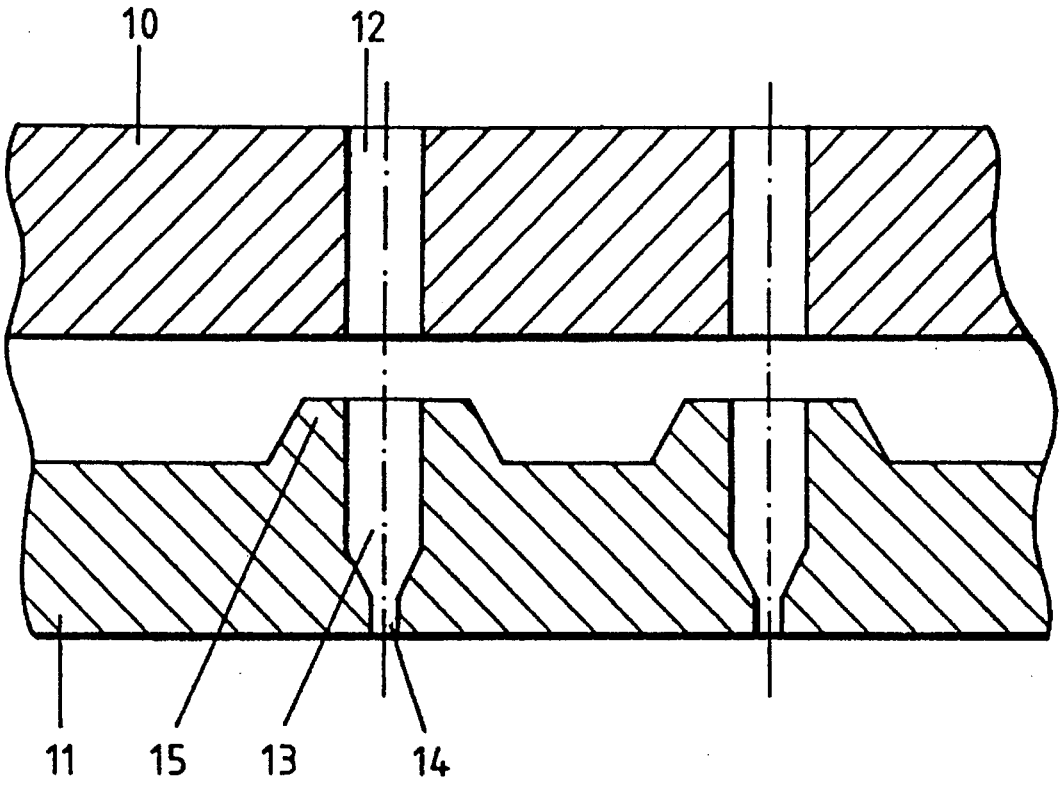
Fig. 3 PRIOR ART
FIG. 3 is a schematic diagram of a spinneret as used in the state of the art.

FIG. 3 shows a detail of a state of the art spinneret where 10 signifies a first spinneret plate and 11 a second spinneret plate. The core melt stream passes through holes 12 in the first spinneret plate 10 into the second spinneret plate 11, more precisely in the goblet shape 13. The sheath stream flows into the space between the spinneret plates 10 and 11 and thus envelops each core stream coming from a hole 12. In this way, each individual stream of core component is enveloped by the sheath component, and thereafter the two components flow conjointly through the goblet 13 into the spinneret orifice 14, from where they are extruded. In the area where the sheath stream envelops the core stream there are elevations 15 provided on the second spinneret plate 11.

Figure 4:
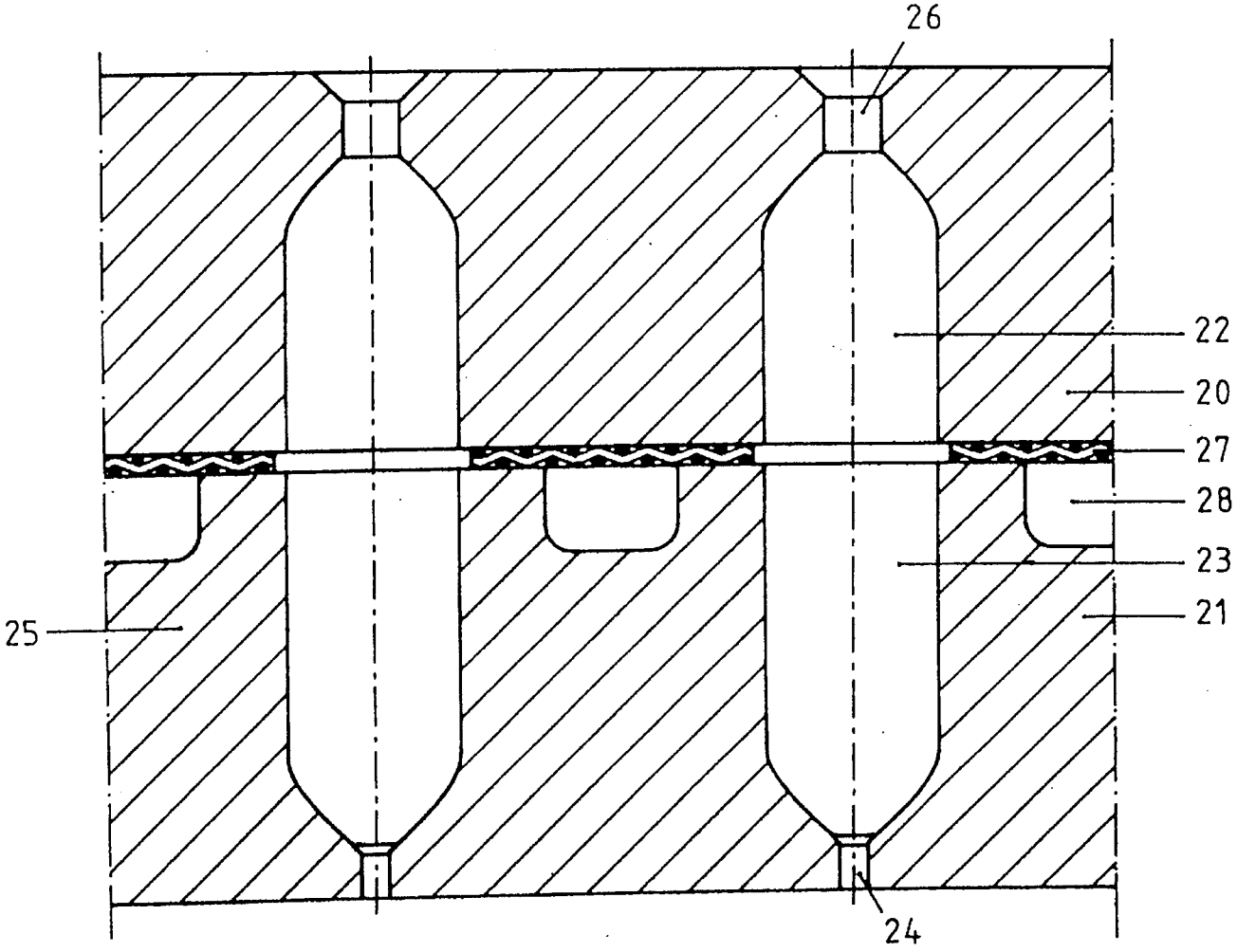
FIG. 4 is a schematic diagram of a spinneret as required for carrying out a process according to the present invention.

FIG. 4 depicts schematically the structure of a spinneret as used in the process according to the present invention. A first spinneret plate is signified by 20 and a second spinneret plate by 21. The core component is introduced through an opening 26 into a die channel 22 which continues in the second spinneret plate 21 as channel 23. The sheath component is uniformly distributed between spinneret plates 20 and 21 via ring channels 28, the space between spinneret plates 20 and 21 having been filled with a metal wire mesh 27 in such a way that the die channels 22 and 23 remain completely open. The sheath component thus passes from the ring channel 28 through the metal wire mesh 27 to envelop the core component. Here the metal wire mesh acts on the sheath component as a flow resistance. The core and sheath components are extruded conjointly via hole 24.

Figure 5:
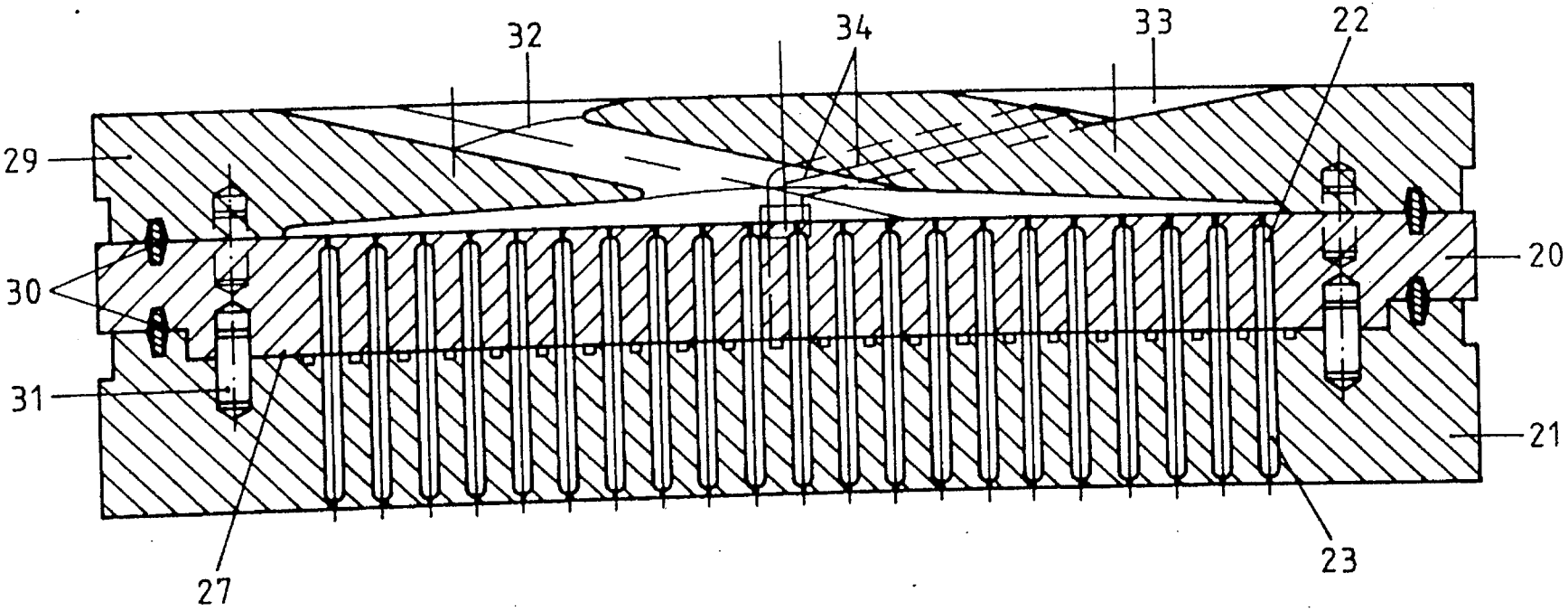
FIGS. 5 and 6 show the construction of the spinneret of FIG. 4.
Figure 6:
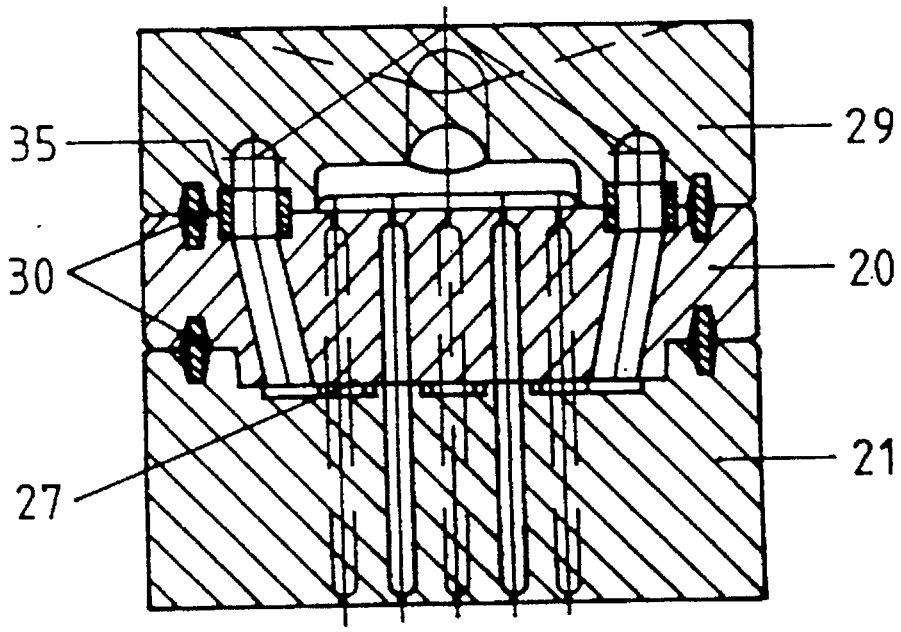

FIGS. 5 and 6 show an embodiment of a spinneret as used for the process according to the present invention, FIG. 5 showing a longitudinal section and FIG. 6 a cross-section. Channel 32 guides the core component in the direction of the first spinneret plate 20, while the sheath component passes through channel 33 (the continuation is shown as a broken line since channel 33 extends outside the plane of the drawing) and its continuation 34 through the first spinneret plate 20 into the ring channels (not referenced) between the first and the second spinneret plate. Between the first plate 20 and the second plate 21 there is a flow resistor 27 which also acts as a spacer between the first and the second plates 20 and 21. Reference numeral 31 signifies centering pins and 30 signifies seals. Bushes 35 prevent any escape of the sheath component between channel plate 29 and first spinneret plate 20.

Figure 7:
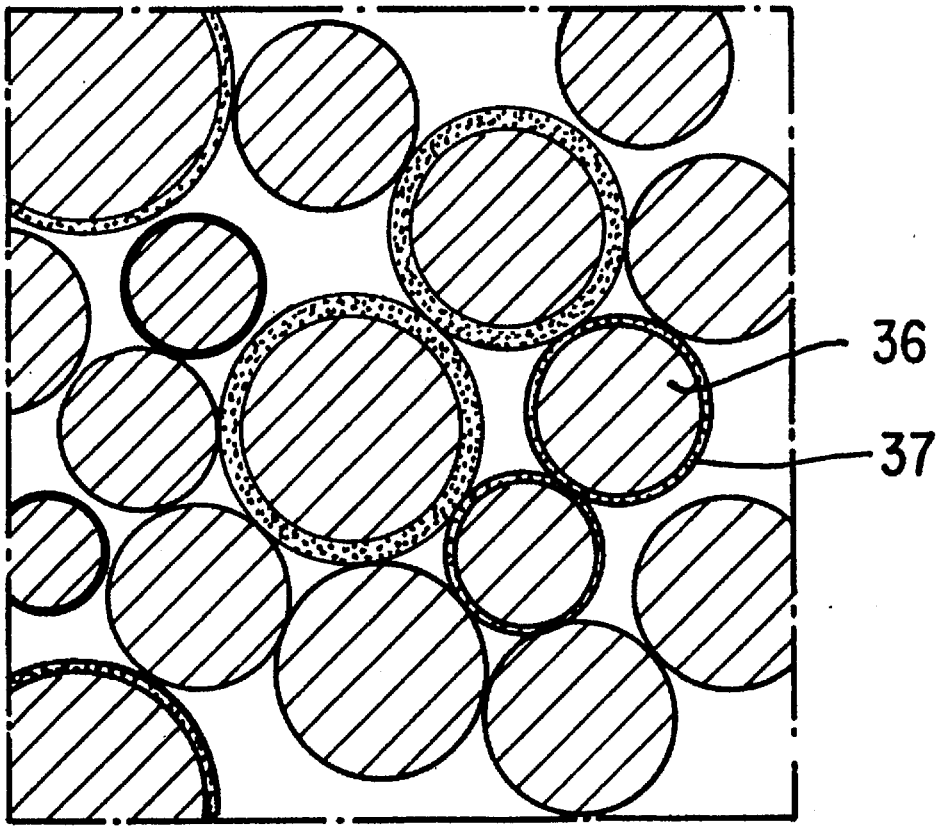
Fig. 7 PRIOR ART
FIG. 7 is a partial cross-section through a yarn according to the state of the art.

FIG. 7 is a partial cross-section through a state of the art core-sheath filament yarn. The sheath is signified by 37 and the core by 36. It can be seen that both the core and the sheath area vary widely from filament to filament. The sheath and/or core areas also vary widely along the length of the individual filaments.

Figure 8:
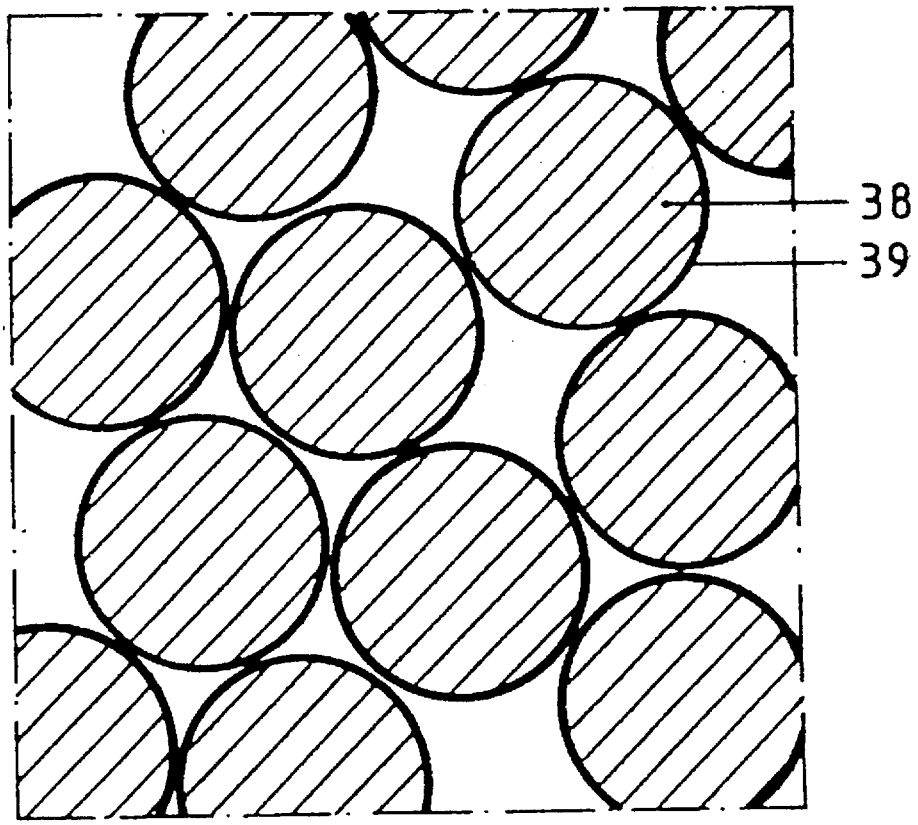
FIG. 8 is a partial cross-section through a yarn according to the present invention.

FIG. 8 shows a corresponding partial cross-section through a yarn according to the present invention. It is notable for the uniformity of the core area 38 and the sheath area 39.

The invention will be further explained with reference to Examples.

EXAMPLES 1 TO 9

Examples 1 to 9 show the range of variation within which the yarns according to the present invention can be produced.

The core polymer used was in Examples 1 to 3 a polyester having a relative viscosity (1 g of polymer in 100 g of m-cresol, measured at 25° C.) typical of textile yarns, in Examples 4 to 6 a polyester having a low relative viscosity for industrial yarns, and in Examples 7 to 9 a polyester having a high viscosity as used for example for tire cord or sewing yarns. The sheath material was nylon 66 (PA 66) in all cases.

Within each of the abovementioned groups of Examples, the spinning pump throughput was varied for both the core and the sheath component. The flow resistor was an R.V.S. 60 mesh rolled (for detailed descriptions see Examples 10 to 15). The spinneret used conformed to that depicted in FIGS. 4 to 6.

The core-sheath filaments were produced by a process as explained above with reference to FIG. 2, except that no drawing was carried out. The process conditions and the polymers used are indicated in Table 1. Table 1 also indicates the percentage, (P(%),) of the core-sheath filaments which contain S % by volume of sheath (taking into account all the core-sheath filaments with (S±0.1 S) % of sheath) in the total volume of the particular filament. The reported P (%) is an average of cross-sectional measurements at various points of the particular yarn.

The P values testify to the uniformity with which the yarns according to the present invention can be made available; also the diameters D of the individual core-sheath filaments in the yarn can be termed very uniform since they are likewise within the range of about (D±0.1 D).

To this end, the core polymer chosen is a polyester having a relative viscosity of 2.04. The sheath material chosen was nylon 66 (PA 66) in Examples 10 and 11 and a mixture of nylon 66 and 0.3% by weight of poly(m-xylyleneadipamide) (identified in the table as "PA66+ additive") in Examples 12 to 15. This mixture shows particularly good adhesivity towards polyester and also towards elastomeric materials, in particular rubber.

Each core-sheath combination was taken up without drawing, once at 900 m/min and once at 500 m/min, again by a process as schematized in FIG. 2. The flow resistor used was an R.V.S. 60 mesh rolled. This mesh thus consisted of stainless steel wires. There were 60 wires per inch in both the longitudinal and the transverse direction. The wires of this commercially available mesh had a diameter of 0.16 mm.

The spinneret used conformed to that depicted in FIGS. 4 to 6.

In Examples 14 and 15, a heating tube 0.4 m in length was placed directly underneath the spinneret to test the effect of delayed quenching. The process conditions chosen are indicated in Table 2.

TABLE 1

| Example | 1 | 2 | 3 | 4 | 5 | 6 | 7 | 8 | 9 |
|---|---|---|---|---|---|---|---|---|---|
| Core | | | | | | | | | |
| Polymer | PET | PET | PET | PET | PET | PET | PET | PET | PET |
| Rel. viscosity | 1.60 | 1.60 | 1.60 | 1.85 | 1.85 | 1.85 | 2.04 | 2.04 | 2.04 |
| Throughput ($cm^3$/min) | 58.0 | 62.0 | 96.0 | 58.0 | 62.0 | 96.0 | 58.0 | 62.0 | 96.0 |
| Pressure (bar) | 60 | 62 | 64 | 88 | 92 | 116 | 136 | 147 | 225 |
| Temperature (°C.) | 299 | 299 | 299 | 299 | 299 | 299 | 299 | 299 | 299 |
| Sheath | | | | | | | | | |
| Polymer | PA66 | PA66 | PA66 | PA66 | PA66 | PA66 | PA66 | PA66 | PA66 |
| Rel. viscosity | 3.12 | 3.12 | 3.12 | 3.12 | 3.12 | 3.12 | 3.12 | 3.12 | 3.12 |
| Throughput ($cm^3$/min) | 9.0 | 6.6 | 6.1 | 9.0 | 6.6 | 6.1 | 9.0 | 6.6 | 6.1 |
| Pressure (bar) | 52 | 41 | 39 | 50 | 48 | 43 | 50 | 48 | 44 |
| Temperature (°C.) | 299 | 299 | 299 | 299 | 299 | 299 | 299 | 299 | 299 |
| Sheath throughput / Core throughput (% by volume) | 15.2 | 11.0 | 6.9 | 15.2 | 11.0 | 6.9 | 15.2 | 11.0 | 6.9 |
| Number of jet holes | 36 | 36 | 36 | 36 | 36 | 36 | 36 | 36 | 36 |
| Jet hole diameter (μm) | 500 | 500 | 500 | 500 | 500 | 500 | 500 | 500 | 500 |
| Spin speed (m/min) | 500 | 500 | 500 | 500 | 500 | 500 | 500 | 500 | 500 |
| P (%) | 94 | 97 | 96 | 98 | 95 | 95 | 97 | 99 | 94 |
| S (%) | 15.2 | 11.0 | 6.9 | 15.2 | 11.0 | 6.9 | 15.2 | 11.0 | 6.9 |

EXAMPLES 10 TO 15

Examples 10 to 15 concern the production of various tire cords and measurement of their properties.

TABLE 2

| Example | 10 | 11 | 12 | 13 | 14 | 15 |
|---|---|---|---|---|---|---|
| Core | | | | | | |
| Polymer | PET | PFT | PET | PET | PET | PET |
| Rel. viscosity | 2.04 | 2.04 | 2.04 | 2.04 | 2.04 | 2.04 |
| Throughput ($cm^3$/min) | 96.0 | 96.0 | 96.0 | 96.0 | 96.0 | 96.0 |
| Pressure (bar) | 175 | 122 | 175 | 175 | 145 | 145 |
| Temperature (°C.) | 293 | 296 | 295 | 295 | 295 | 295 |

TABLE 2-continued

| Example | 10 | 11 | 12 | 13 | 14 | 15 |
|---|---|---|---|---|---|---|
| Sheath | | | | | | |
| Polymer | PA66 | PA66 | PA66 + additive | PA66 + additive | PA66 + additive | PA66 + additive |
| Rel. viscosity | 3.12 | 3.12 | 3.12 | 3.12 | 3.12 | 3.12 |
| Throughput ($cm^3$/min) | 6.1 | 6.1 | 6.1 | 6.1 | 6.1 | 6.1 |
| Pressure (bar) | 75 | 52 | 73 | 73 | 50 | 50 |
| Temperature (°C.) | 293 | 296 | 295 | 295 | 295 | 295 |
| Sheath throughput / Core throughput (% by volume) | 6.9 | 6.9 | 6.9 | 6.9 | 6.9 | 6.9 |
| Number of jet holes | 36 | 36 | 36 | 36 | 36 | 36 |
| Jet hole diameter (μm) | 500 | 500 | 500 | 500 | 500 | 500 |
| Length of heating tube (m) | — | — | — | — | 0.4 | 0.4 |
| Temperature of heating tube (°C.) | — | — | — | — | 290 | 290 |
| Spin speed (m/min) | 900 | 500 | 900 | 500 | 900 | 500 |

The yarns obtained were then drawn in a drawing unit. This involved running the yarn off the bobbin into a first trio. From the trio the yarn ran via a septet to a second-trio and from there through a steam treatment section 10 m in length where the yarn was treated with steam at 250° C., and the yarn passed into a third trio and was then wound up while the drawing speed was maintained. The septet was maintained at a temperature of 75° C.

The draw ratios and drawing speeds chosen for the yarns of Examples 10 to 15 are evident from Table 3, where "draw ratio septet" denotes the draw ratio applied to the yarn on passing through the septet. The figure for the total draw ratio is obtained from the speed difference between the first and the third trio.

TABLE 3

| Example | 10 | 11 | 12 | 13 | 14 | 15 |
|---|---|---|---|---|---|---|
| Draw ratio septet | 2.48 | 3.30 | 2.51 | 3.10 | 3.21 | 3.70 |
| Draw ratio total | 3.80 | 5.45 | 3.80 | 5.10 | 5.15 | 6.50 |
| Drawing speed (m/min) | 138 | 185 | 138 | 144 | 185 | 184 |

The properties of the yarn obtained in this way are listed in Table 4 under "yarn". In the table, LASE 1% (N) indicates the strength of the yarn in (N) under a load at a specific elongation of 1%. The same applies to LASE 2% and LASE 5%.

HAS 4'/160° C. indicates the hot air shrinkage of the yarn on exposure at 160° C. for 4 minutes to a load of 5 mN/tex.

The yarns obtained were each formed into a tire cord of the construction 1100 (Z 472) x 2 (S 472). The properties of the tire cord of this construction are likewise listed in Table 4 under the heading "cord".

The cord obtained in this manner was coated with an adhesive in a conventional manner. To this end, the cord was passed in succession under a tension of 5N through an oven at 150° C. in the course of 120 seconds, then through a bath and then under a tension of 5N through an oven at 240° C. in the course of 45 seconds. The bath contained the following ingredients:

Demineralized water,

Sodium hydroxide solution,

Resorcinol,

Formaldehyde,

VP latex,

Ammonia.

The properties of the cord treated in this way are likewise listed in Table 4 under "dipped cord".

The P and S values were identical for the yarn, the cord and the dipped cord, which is why these values are in each case only listed under "yarn".

TABLE 4

| Example | 10 | 11 | 12 | 13 | 14 | 15 |
|---|---|---|---|---|---|---|
| Yarn | | | | | | |
| Denier (dtex) | 1384 | 1073 | 1382 | 1108 | 1029 | 874 |
| Tenacity (mN/tex) | 717 | 803 | 723 | 816 | 837 | 933 |
| Elongation (%) | 9.3 | 10.9 | 9.4 | 9.5 | 11.5 | 9.4 |
| LASE 1% (N) | 13.2 | 11.1 | 13.5 | 11.3 | 10.8 | 9.8 |
| LASE 2% (N) | 21.4 | 17.4 | 21.6 | 18.2 | 17.0 | 15.0 |
| LASE 5% (N) | 53.0 | 43.3 | 53.3 | 45.4 | 43.4 | 39.0 |
| HAS 4'/160° C. (%) | 3.3 | 4.6 | 3.3 | 4.3 | 4.5 | 5.6 |
| P (%) | 96 | 98 | 94 | 97 | 96 | 97 |
| S (%) | 6.9 | 6.9 | 6.9 | 6.9 | 6.9 | 6.9 |
| Cord | | | | | | |
| Denier (dtex) | 3141 | 2376 | 3120 | 2467 | 2247 | 1893 |
| Tenacity (mN/tex) | 541 | 631 | 551 | 646 | 672 | 758 |
| Elongation (%) | 16.5 | 15.0 | 16.5 | 14.9 | 15.0 | 12.6 |
| LASE 1% (N) | 8.1 | 8.7 | 8.3 | 8.9 | 9.6 | 9 6 |
| LASE 2% (N) | 15.8 | 16.4 | 16.2 | 17.0 | 17.8 | 17.4 |
| LASE 5% (N) | 34.7 | 33.9 | 35.5 | 35.7 | 37.9 | 36.9 |
| HAS 4'/160° C. (%) | 4.6 | 6.3 | 4.7 | 5.8 | 6.1 | 7.3 |
| Dipped cord | | | | | | |
| Denier (dtex) | 3360 | 2533 | 3353 | 2633 | 2420 | 2035 |
| Tenacity (mN/tex) | 498 | 583 | 501 | 578 | 617 | 645 |
| Elongation (%) | 16.3 | 15.6 | 16.5 | 15.1 | 16.0 | 13.2 |
| LASE 1% (N) | 12.5 | 12.3 | 12.2 | 12.0 | 12.5 | 11.8 |
| LASE 2% (N) | 22.8 | 21.5 | 22.4 | 21.4 | 21.6 | 20.5 |
| LASE 3% (N) | 46.5 | 44.8 | 44.9 | 44.2 | 44.8 | 43.9 |
| HAS 4'/160° C. (%) | 1.5 | 2.0 | 1.4 | 1.8 | 2.0 | 2.3 |

We claim:

1. Process for producing a yarn comprising core-sheath filaments, said yarn having a proportion of core-sheath filaments P having a substantially identical sheath content S, wherein a core and a sheath of the core-sheath filaments have been produced by extruding spinnable polymers, and out of 100% of the core-sheath filaments, P, in %, having sheath content within a range of (S ±0.1 S) % is a value defined by an area of FIG. 1 bounded by and including curve DE, line EF and line DF, wherein curve DE is represented by the formula $P=30+(0.1\ S)^8\%$, said process comprising:

feeding a core component through a first spinneret plate to a second spinneret plate in a plurality of individual streams;

enveloping, between the first and the second spinneret plates, each individual stream of core component by a sheath component fed onto it;

conjointly spinning, drawing and winding up the two components, and, at least in an area surrounding the plurality of individual streams of core component, subjecting the sheath component to a flow resistance through a flow resistor to produce said yarn comprising core-sheath filaments.

2. Process according to claim 1, wherein the flow resistor is a wire mesh with a hole for each individual stream.

3. Process according to claim 1, wherein the flow resistor has a permeability between $10^{-11}$ and $3\times10^{-10}$ $m^2$.

4. Process according to claim 2, wherein the wire mesh has from 30 to 500 wires per inch.

5. Process according to claim 1, wherein said yarn further comprises homofilaments, said process further comprising temporarily adjusting the flow resistance to prevent said enveloping and produce said homofilaments.

6. Process according to claim 1, wherein at least one of the sheath and core component is melt-spun.

7. Process according to claim 1, wherein at least one of the sheath and core components is solvent-spun.

8. Process according to claim 1, wherein the first and second spinneret plate each contain only one spinneret orifice.

9. A process for producing a core-sheath filament yarn, comprising:

feeding core component polymer streams through first die channels in a first spinneret plate toward corresponding second die channels in a second spinneret plate, the core component polymer streams passing through spaces that separate the corresponding first and second die channels;

feeding sheath component polymer streams through ring channels in the second spinneret plate and into contact with the core component polymer streams at the spaces that separate the corresponding first and second die channels, while subjecting the sheath component polymer streams to a flow resistance in the ring channels at locations adjacent to and surrounding the spaces that separate the corresponding first and second die channels, thereby enveloping the core component polymer streams with the sheath component polymer streams to form core-sheath filaments; and drawing and winding up the core-sheath filaments to form a core-sheath filament yarn having a proportion of core-sheath filaments P having a substantially identical sheath content S, wherein out of 100% of the core-sheath filaments, P, in % having sheath content within a range of $(S\pm0.1\ S)\%$, is a value defined by an area of FIG. 1 bounded by and including curve DE, line EF and line DF, wherein curve DE is represented by the formula $P=30+(0.1\ S)^8\%$.

10. A process for producing a core-sheath filament yarn, comprising:

feeding core component polymer streams and sheath component polymer streams through a spinneret, while subjecting the sheath component polymer streams to flow resistance at locations adjacent to points of contact between the core component polymer streams and sheath component polymer streams, thereby enveloping the core component polymer streams with the sheath component polymer streams to form core-sheath filaments; and drawing and winding up the core-sheath filaments to form a core-sheath filament yarn having a proportion of core-sheath filaments P having a substantially identical sheath content S, wherein out of 100% of the core-sheath filaments, P, in % having sheath content within a range of $(S\pm0.1\ S)\%$, is a value defined by an area of FIG. 1 bounded by and including curve DE, line EF and line DF, wherein curve DE is represented by the formula $P=30+(0.1\ S)^8\%$.

* * * * *